US005320323A

United States Patent [19]

Clark, Jr.

[11] Patent Number: 5,320,323

[45] Date of Patent: Jun. 14, 1994

[54] TREE STAND

[75] Inventor: Franklin T. Clark, Jr., Girard, Pa.

[73] Assignee: Emsco, Inc., Girard, Pa.

[21] Appl. No.: 969,569

[22] Filed: Oct. 30, 1992

[51] Int. Cl.[5] ..... A47G 7/02

[52] U.S. Cl. ..... 248/523; 47/40.5; 248/527

[58] Field of Search ..... 248/523, 524, 527; 47/40.5

[56] References Cited

U.S. PATENT DOCUMENTS

| | | | |
|---|---|---|---|
| 1,846,891 | 2/1932 | Miller . | |
| 1,914,150 | 6/1933 | Muldoon . | |
| 2,044,192 | 6/1936 | Templin, Jr. | 248/44 |
| 2,733,032 | 1/1956 | Farley et al. | 248/44 |
| 2,891,747 | 6/1959 | Steede | 248/524 X |
| 2,905,414 | 9/1959 | Zierden | 248/44 |
| 2,913,202 | 11/1959 | Meldrum | 248/44 |
| 3,073,558 | 1/1963 | De Klotz | 248/527 X |
| 4,130,965 | 12/1978 | Patton et al. | 248/524 X |
| 4,408,415 | 10/1983 | Davis et al. | 47/40.5 |
| 4,571,881 | 2/1986 | Lathim | 248/527 X |
| 4,884,363 | 12/1989 | Sofy | 47/40.5 |
| 5,160,110 | 11/1992 | Praegitzer | 248/523 |

FOREIGN PATENT DOCUMENTS

| | | | |
|---|---|---|---|
| 478647 | 1/1938 | United Kingdom | 248/527 |

*Primary Examiner*—Robert W. Gibson, Jr.
*Attorney, Agent, or Firm*—Lovercheck and Lovercheck

[57] ABSTRACT

A Christmas tree stand having a cylindrical water container and a skirt having a downwardly and outwardly extending skirt. Screws on the top of the tree stand engage the sides of a tree trunk and a pointed member on a non-circular metal disk engage the bottom of the tree trunk. The metal disk is received in a non-circular boss attached to the bottom of the container so that the disk may be rotated and its edges bite into the internal walls of the boss opening.

20 Claims, 3 Drawing Sheets

TREE STAND

BACKGROUND OF THE INVENTION

The present invention relates to tree stands and more particularly to stands for supporting Christmas trees.

Applicant is aware of the following U.S. Patents that show tree stands with various structures to engage the distal end of the tree trunk: 1,846,891 to Miller; 1,914,150 to Muldoon; 2,044,192 to Templin, Jr.; 2,733,032 to Farley et al; 2,905,414 Zierden; 2,913,202 to Meldrum and 4,884,363 to Sofy. However, none of these tree stands have a simple, economical and efficient means for engaging the lower end of the Christmas tree trunk to support it in a fixed position.

SUMMARY OF THE INVENTION

Applicant has provided an improved, simple and efficient Christmas tree stand. The tree stand of the present invention includes a liquid container with a skirt attached to the top thereof which extends outwardly and downwardly from the top of the stand to a floor engaging flange. A first tree trunk engaging means is supported at the top of the liquid container and an improved tree trunk bottom engaging means is supported on the bottom of the container. Applicant has also provided an improved method of making an improved Christmas tree stand.

It is an object of the present invention to provide an improved Christmas tree stand.

Another object of the invention is to provide a Christmas tree stand that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
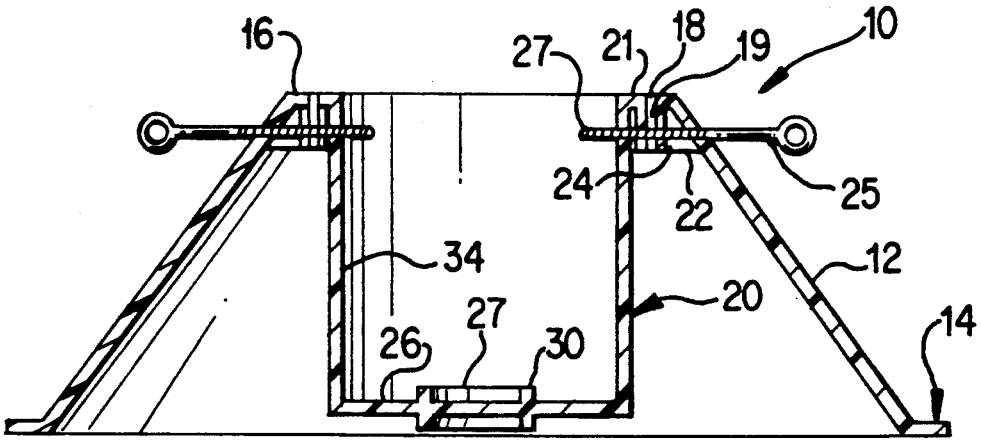
FIG. 1 is a longitudinal cross sectional view of a Christmas tree stand according to the invention.
Figure 2:
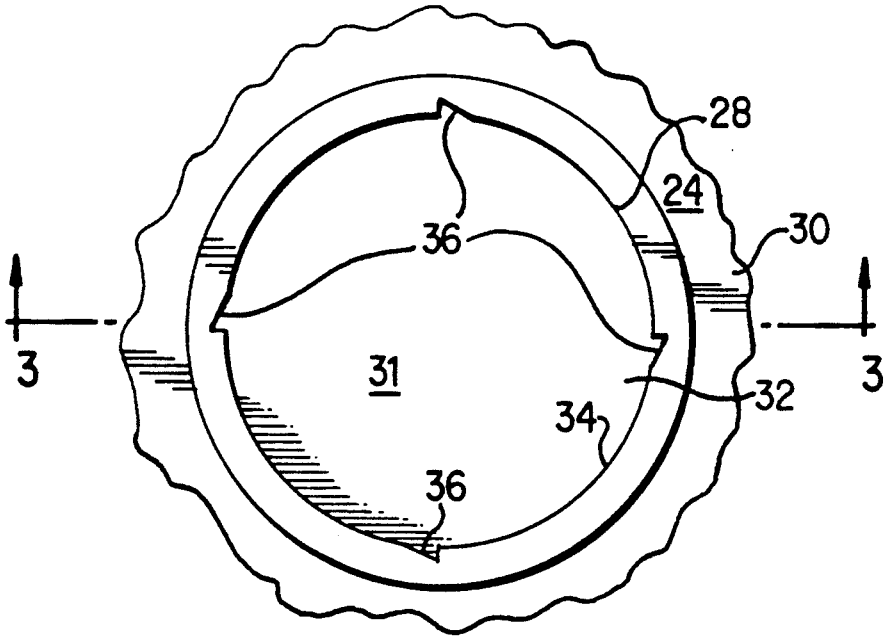
FIG. 2 is an enlarged partial top view of FIG. 1
Figure 3:
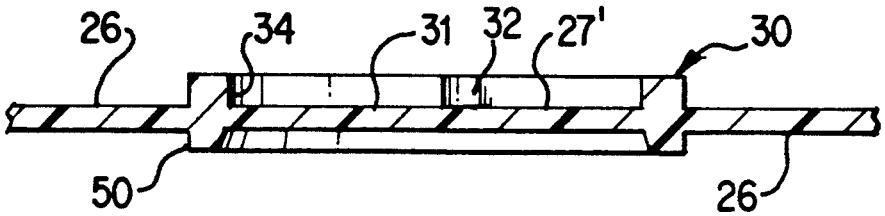
FIG. 3 is a cross sectional view taken on line 3—3 of FIG. 2.
Figure 4:
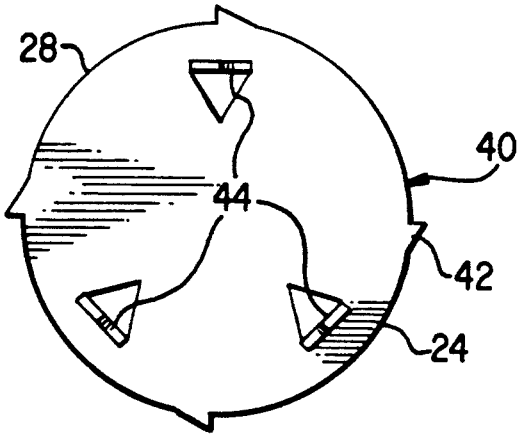
FIG. 4 is an enlarged top view of a metal disk for use with the embodiment of FIGS. 1 and 2.
Figure 5:
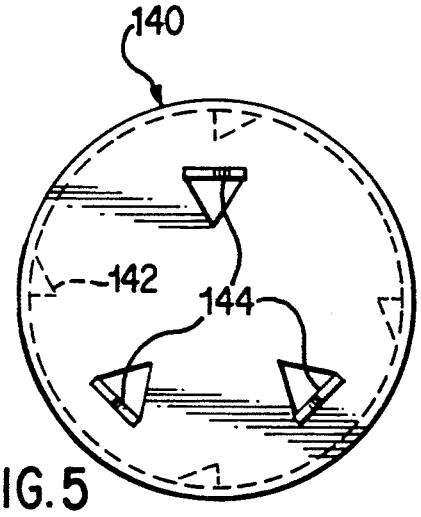
FIG. 5 is a top view similar to FIG. 4 of another embodiment of the invention.

Now with more particular reference to the drawings, FIGS. 1 through 4 show tree stand 10 with outwardly and downwardly extending skirt 12. Skirt 12 terminates at its lower outer edge in floor engaging flange 14. Annular top 16 of tree stand 10 has spaced slots 18 which receive nuts 19.

Hollow cylindrical water container 20 has upper end 21 integrally attached to an inner edge of annular top 16. An outer annular edge of annular top 16 is integrally attached to the upper edge of skirt 12. Circumferentially spaced webs 22 connect outer peripheral walls 24 of water container 20 to skirt 12 adjacent the upper edge thereof. Each web 22 has drain hole 23 to drain any water that may enter the space above bolts 25. Bolts 25, acting as first supports, are threadably received in nuts 19, have inner ends 27 that engage the trunk of a Christmas tree to adjust the tree laterally. Water container 20 has bottom 26. Annular boss 30 is integrally attached to bottom 26 at the center thereof and extends upwardly from bottom 26. Annular boss 30 has generally cylindrical wall 34 defining cavity 32. Wall 34 has circumferentially spaced vertically extending slots 36, which act as detents, extending from top 29 of annular boss 30 to bottom 31 of cavity 32.

Circular sheet metal disk 40, which acts as a second support, is received in cavity 32 of annular boss 30 on cylindrical wall 34. Disk 40 has integrally attached, outwardly extending teeth 42, which act as detents, and are inclined relative to periphery 28 of disk 40. Teeth 42 are received in slots 36. When disk 40 is rotated slightly relative to annular boss 30, outwardly extending teeth 42 penetrates the edge of vertically extending slots 36 and laches disk 40 in position. When disk 40 is inserted in cavity 32 with teeth 42 in slots 36, upwardly extending points 44, which are stuck out of and integrally attached to disk 40, penetrate the lower end of a Christmas tree trunk and hold the lower end of the tree in position. When disk 40 rests on bottom 26 of water container 20 and is rotated relative to annular boss 30, teeth 42 penetrate cylindrical wall 34 of annular boss 30, along side of slots 36, to hold disk 40 in position. Downwardly extending circular boss 50 is integrally attached to bottom 26 of water container 20, directly below annular boss 30 to carry the weight of the tree through circular boss 50 to re-enforce bottom 26. Circular boss 50 extends down to a plane passing through the bottom of flange 14 and rests on a floor to support the weight of a tree.

Now with more particular reference to the embodiment shown in FIGS. 5 through 8, tree stand 110, similar to tree stand 10 shown in FIGS. 1 through 4, has a second support holding the bottom end of the tree in position and has annular boss 130 on bottom 126 of a water container.

The second support, in the form of metal disk 140, has annular downwardly extending flange 146 integrally attached to outer periphery 128 thereof. Inwardly extending teeth 142 are integrally attached to the lower end of flange 146. Teeth 142 are received in slots 136, in annular boss 130, which hold metal disk 140 to annular boss 130. Downwardly extending second boss 150 is integrally attached to bottom 126 directly below annular boss 130 to re-enforce bottom 126.

Figure 9:
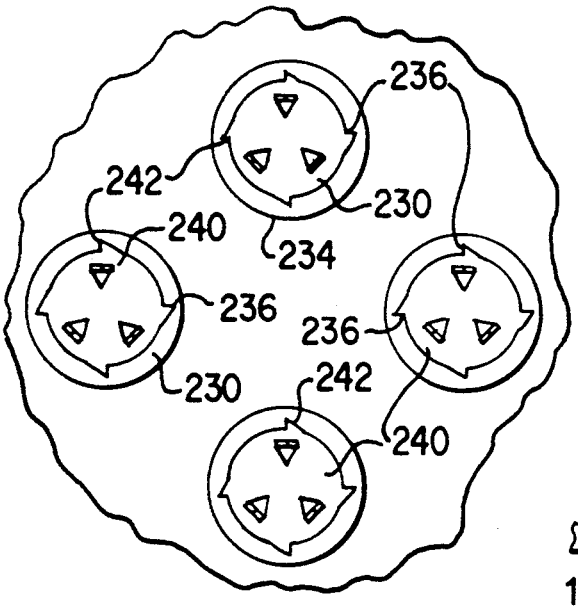
FIG. 9 is an enlarged partial top view, similar to FIGS. 2 and 8, of a Christmas tree stand according to another embodiment of the invention.
Figure 6:
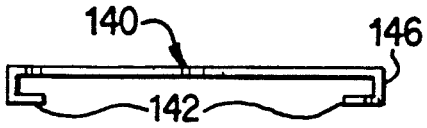
FIG. 6 is an enlarged partial cross sectional view taken on line 6—6 of FIG. 5.
Figure 7:
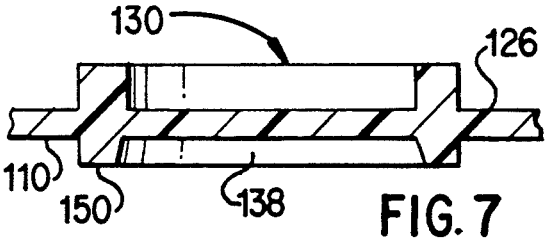
FIG. 7 is a cross sectional view taken on line 7—7 of FIG. 8.
Figure 8:
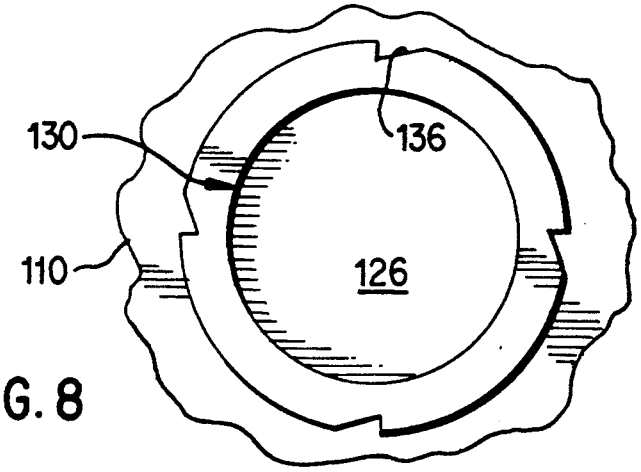
FIG. 8 is an enlarged partial top view, similar to FIG. 2, of the embodiments shown in FIGS. 5, 6 and 7.

Now with specific reference to the embodiment of FIG. 9, the tree stand is like tree stand 10 shown in FIG.

1, except that several lower trunk supports are used. Bottom 226, of a water container similar to container 20 shown in FIG. 1, has a plurality of small integrally attached, upwardly extending bosses 230 and a plurality of circular disks 240 supported on bosses 230. Bosses 230 have slots 236 which receive teeth 242 on disks 240. Disks 240 each have upwardly extending points 244 that penetrate the tree trunk. A plurality of bosses 230 hold the lower end of some trees better than a single larger support as in the previous embodiments.

Figure 10:
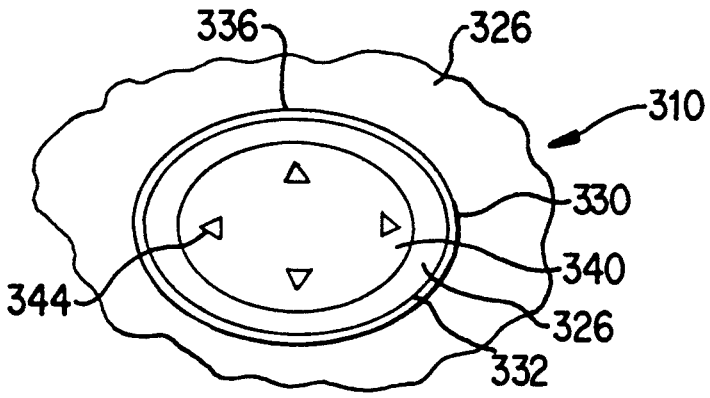
FIG. 10 is a top view of another embodiment of the invention.
Figure 11:
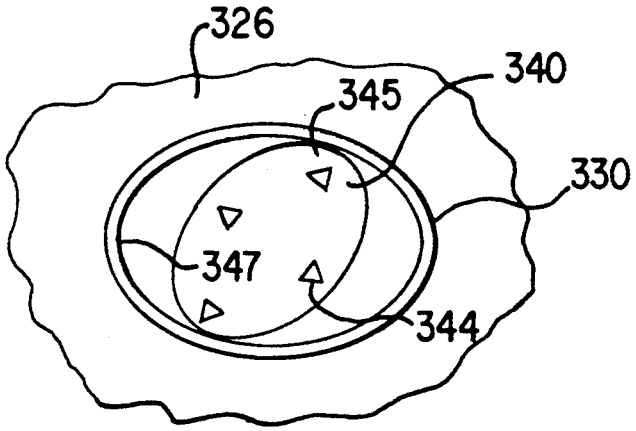
FIG. 11 is a top view of another embodiment of the invention.

Now with specific reference to the embodiment of FIGS. 10 and 11, Christmas tree support 310 has water container bottom 326 with upwardly extending elliptical boss 330 having elliptical inside wall 336. Elliptical disks 340 rests on bottom 331 of elliptical cavity 332. Points 344 are integrally attached to elliptical disks 340 and penetrates the bottom of a tree trunk when the tree trunk is placed in Christmas tree support 310.

The major dimension of elliptical disks 340 is slightly greater than the minor dimensions of elliptical cavity 332 in elliptical boss 330 so that when elliptical disk 340 is rotated, ends 345 of elliptical disk 340 penetrates inside walls 347 of upwardly extending elliptical boss 330 thereby holding elliptical disk 340 in place.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A tree stand for supporting a tree comprising a liquid container having an open top, an outer peripheral wall and a bottom;

a skirt fixed to said container adjacent said open top;

said skirt extending outwardly and downwardly from said open top at an acute angle;

a first support means supported on said tree stand adjacent said open top for engaging sides of said tree;

a second support means comprising a non-circular boss means on said bottom and a non-circular tree engaging means adapted to engage a tree and to engage said second support means whereby said non-circular tree engaging means frictionally engages said non-circular boss means when said non-circular tree engaging means is rotated relative to said non-circular boss means.

2. The tree stand recited in claim 1 wherein said non-circular boss means and said non-circular tree engaging means are generally elliptical.

3. The tree stand recited in claim 2 wherein said non-circular tree engaging means has a major axis and a minor axis.

4. The tree stand recited in claim 1 wherein said non-circular tree engaging means comprises teeth; and said non-circular boss means comprises slots receiving said teeth and said teeth adapted to penetrate said non-circular boss means when said non-circular tree engaging means is rotated.

5. The tree stand recited in claim 4 wherein said non-circular boss means is integrally attached to said bottom and extends upwardly therefrom; and, said slots are formed in an outer surface of said non-circular boss means.

6. The tree stand recited in claim 4 wherein said non-circular boss means extends upwardly from said bottom and has a non-circular cavity therein defined by walls with said slots therein;

said non-circular tree engaging means comprises a disk having said teeth on an outer periphery thereof and said teeth adapted to be received in said slots whereby said teeth engage said non-circular boss means when said disk is rotated.

7. The tree stand recited in claim 4 wherein said non-circular boss means has a non-circular cavity therein;

said cavity being defined by a wall means and said cavity adapted to receive a metal disk.

8. The tree stand recited in claim 6 wherein said disk is metal;

said disk having an annular flange attached thereto and extending downward over said non-circular boss means;

said annular flange having inwardly directed teeth thereon;

said non-circular boss means having an outer, generally cylindrical surface; and, slots in said non-circular boss means adapted to receive said teeth for holding said disk to said non-circular boss means.

9. The tree stand recited in claim 8 wherein said teeth are inclined tangentially to said metal disk whereby said teeth are adapted to cut into said non-circular boss means thereby holding said metal disk to said non-circular boss means.

10. The tree stand recited in claim 7 wherein a plurality of said non-circular boss means are integrally attached to said bottom; and, a plurality of said metal disks each adapted to be supported on a particular one of said non-circular boss means.

11. The tree stand recited in claim 9 wherein said bottom of said liquid container has a plurality of circular bosses integrally attached to said bottom on a side of said bottom opposite said non-circular boss means and adapted to support said tree.

12. The tree stand recited in claim 11 wherein each said circular boss has a non-circular cavity therein.

13. The tree stand recited in claim 6 wherein said cavity is elliptical in shape and said disk is elliptical shaped; and, said disk having a major dimension greater than the dimension of said cavity.

14. The tree stand recited in claim 12 wherein said disk is generally round and adapted to be rotated causing said teeth to penetrate said circular boss.

15. The tree stand recited in claim 6 wherein said bottom of said container has a circular boss on a side of said bottom opposite said non-circular boss means;

said circular boss adapted to rest on a supporting surface for supporting the weight of said tree.

16. A tree stand for supporting a tree comprising a liquid container having an open top, an outer peripheral wall and a bottom;

a skirt fixed to said container adjacent said open top;

said skirt extending outwardly and downwardly from said open top at an acute angle;

a first support means supported on said tree stand adjacent said open top for engaging sides of said tree;

a second support means on said bottom for supporting a lower end of said tree;

said first support means comprising threaded bolts extending through said skirt adjacent an upper end thereof and adapted to engage a tree trunk;

said second support means comprising a disk and a boss integrally attached to said bottom;

said boss having vertically extending slots therein;

teeth on said disk being received in said slots holding said disk in place on said cylindrical boss; and, upwardly extending points on said disk adapted to engage said tree.

17. The tree stand recited in claim 16 wherein said boss has a cavity therein; and, said disk being adapted to be received in said cavity.

18. The tree stand recited in claim 16 wherein said slots are disposed in said outer periphery of said boss;

said disk having a downwardly extending flange; and, said flange has inwardly extending teeth attached thereto adapted to be received in said slots.

19. The tree stand recited in claim 16 wherein said disk is generally round and is adapted to be rotated causing said teeth to penetrate said boss.

20. The tree stand recited in claim 16 wherein a plurality of said bosses are supported on said bottom of said tree stand and a plurality of said disks are supported in said cavity.

* * * * *